United States Patent [19]

Cavanagh et al.

[11] 4,083,498

[45] Apr. 11, 1978

[54] FUEL INJECTION NOZZLES

[75] Inventors: Eric Joseph Cavanagh, Surbiton; Ivor Fenne, Greenford, both of England

[73] Assignee: Lucas Industries Limited, Birmingham, England

[21] Appl. No.: 732,339

[22] Filed: Oct. 14, 1976

[30] Foreign Application Priority Data

Oct. 21, 1975 United Kingdom ..... 43073/75

[51] Int. Cl.[2] ..... B05B 1/30

[52] U.S. Cl. ..... 239/533.3; 239/533.11

[58] Field of Search ..... 239/533.2–533.12; 251/332, 333, 359, 365

[56] References Cited

U.S. PATENT DOCUMENTS

| | | | |
|---|---|---|---|
| 933,863 | 12/1909 | Thompson | 251/333 |
| 1,526,248 | 2/1925 | Small | 251/333 X |
| 2,904,877 | 9/1959 | Edelen | 251/333 X |

FOREIGN PATENT DOCUMENTS

| | | | |
|---|---|---|---|
| 403,751 | 1/1924 | Germany | 239/533.12 |
| 402,510 | 3/1966 | Switzerland | 239/533.3 |

*Primary Examiner*—John J. Love

[57] ABSTRACT

A fuel injection nozzle includes a valve member axially slidable within a bore and shaped at its end to define a substantially conical valve surface which co-operates with a seating surface to control the flow of fuel through outlet orifices. One of said surfaces defines two spaced hardened zones for co-operation with the other surface, the outlet orifice extending from intermediate said zones.

10 Claims, 3 Drawing Figures

FUEL INJECTION NOZZLES

This invention relates to fuel injection nozzles of the kind intended to be mounted in the cylinder head of an internal combustion engine for directing fuel into a combustion space of the engine, the nozzle being of the kind comprising a body in which is defined a bore, an outlet orifice communicating with one end of the bore and a valve member slidable in the bore and having a valve surface for co-operation with a seating surface to control flow of fuel through the outlet orifice from the bore.

The object of the invention is to provide such a nozzle in a simple and convenient form.

According to the invention in a nozzle of the kind specified said seating surface and said valve surface define a pair of axially spaced sealing zones, said outlet orifice extending from said seating surface intermediate said sealing zones, one of said surfaces intermediate said zones being constructed of softer material than the material forming said zones.

Figure 1:
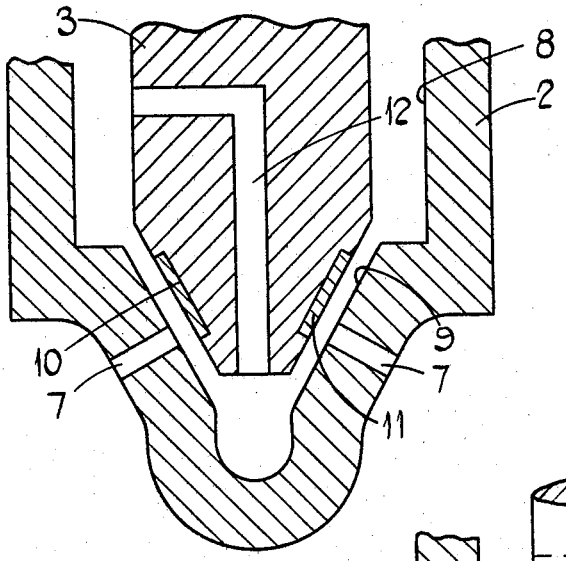
Figure 2:
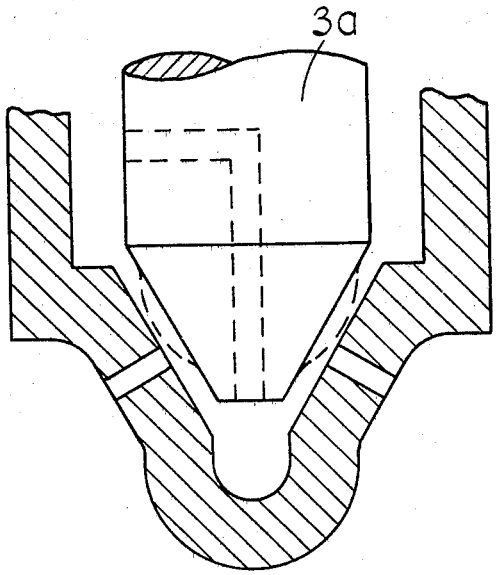
Figure 3:
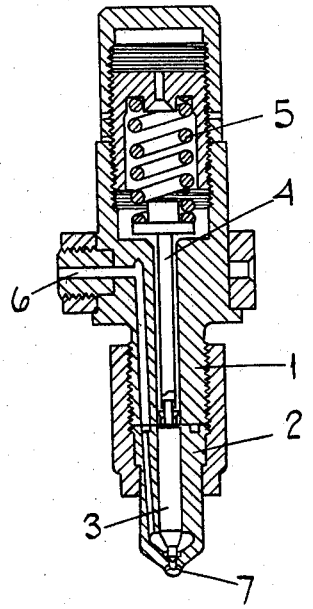

Two examples of a fuel injection nozzle in accordance with the invention will now be described with reference to the accompanying drawings in which:

FIGS. 1 and 2 are sectional side views to an enlarged scale, showing parts of the two nozzles and FIG. 3 is a sectional side elevation of a complete nozzle.

With reference to FIG. 3 the nozzle comprises a body a multi-part body including a main body 1 of generally cylindrical form to which is secured a nozzle head 2. The nozzle head accommodates a valve member 3 slidable within a bore and the valve member is urged into contact with a seating surface by means of a coiled compression spring 5 which acts upon the valve member through a push rod 4. The valve member 3 can be lifted from the seating by fuel under pressure which is supplied through an inlet 6 and which acts upon a stepped portion of the valve member. When the valve member has been lifted from the seating surface fuel can flow through outlet orifices 7 to a combustion space of an associated engine and can continue to flow so long as fuel is supplied through the inlet. When the flow of fuel ceases the valve member is closed onto the seating by the spring 5. Such nozzles are well known and are widely used.

One of the problems with such nozzles is to ensure an adequate seal between the valve member and the seating remembering that this seal must withstand the high temperature and pressure conditions which exist in the combustion space of an engine.

With reference now to FIG. 1 of the drawings shown in the nozzle body 2 is the bore referenced 8 and at the end of the bore there is formed the annular conical seating surface 9. Slidable within the bore 8 is the stepped valve member 3 the narrower portion of which is shaped to co-operate with the sealing surface 9. An annular space is defined between the bore 8 and the narrower end of the valve member and this space communicates with the fuel inlet 6. The nozzle in use is mounted in the cylinder head of an associated engine and the outlet orifices 7 direct liquid fuel into a combustion space of the engine. As mentioned the valve member 3 is urged to the closed position by means of the coiled compression spring 5 and it is lifted against the action of the spring, by the fuel under pressure supplied to the inlet.

The end of the narrower portion of the valve member 3 is of complementary shape to the seating surface 9, the conical angles being the same.

It would be difficult to ensure a fluid seal over the whole of the seating surface and to avoid this problem a pair of seating zones are defined by the seating surface 9 and the shaped end of the valve member 3. The sealing zones are axially spaced and the outlet orifices 7 extend from intermediate the sealing zones.

In the example of FIG. 1 the portion of the narrower end of the valve member intermediate the sealing zones is constituted by material which is softer than the material of the valve member which defines the sealing zones. As will be seen in FIG. 1 a groove 10 is machined in the conical surface of the valve member and the groove is filled by an insert 11. In a particular example, the insert is formed from copper, the remaining portion of the valve member being formed from steel. One method of forming the insert is to machine the groove 10 and then electro-plate the end of the valve member and finally machine the valve member to the desired conical form. In this manner the insert can deform under the action of the force exerted by the spring so as to provide good sealing zones which act to seal the outlet orifices from the aforesaid annular space on one side and also the end of the bore on the other side. In order to permit the valve member to move into the closed position, the aforesaid end of the bore is placed in communication with the annular space by means of an axial passage 12 formed in the valve member and which terminates in a transverse passage.

In this manner in the closed position of the valve member the outlet orifices 7 are closed off from the various spaces within the nozzle body and which are filled with fuel even at the end of the delivery of fuel by the injection pump.

In the example of FIG. 2, the valve member 3*a* is again provided with the softer zone intermediate the portions of the valve member which form the sealing zones. This is achieved during the manufacture of the valve member by firstly machining the end of the valve member to a convex shape as shown by the dotted lines. The end of the valve member is then subjected to a case hardening process and finally the valve member is ground to the desired truncated conical shape. During the grinding process metal is removed leaving two axially spaced zones which are case hardened with a soft zone between the two hardened zones, the soft zone being constituted by the material from which the valve member is formed.

It will be understood that the seating surface 9 may be manufactured in a similar manner to produce the same effect.

We claim:

1. A fuel injection nozzle of the kind intended to be mounted in the cylinder head of an internal combustion engine for directing fueld into a combustion space of the engine, the nozzle comprising a body, a bore defined in the body, an outlet orifice communicating with one end of the bore, a valve member slidable in the bore, a seating surface adjacent said one end of the bore, said valve member having a valve surface shaped for co-operation with said seating surface to control fuel flow through said orifice from the bore, said seating surface and said valve surface defining a pair of axially spaced annular sealing zones, the outlet orifice extending from said seating surface intermediate said sealing zones, one of said surfaces intermediate said zones being constructed of softer material than the material forming said zones.

2. A nozzle according to claim 1 in which an annular space is defined between the wall of the bore and the valve member, said space communicating with a fuel inlet, and passage means through which the end of said bore is in communication with said space.

3. A nozzle according to claim 2 in which said passage means is defined in the valve member.

4. A nozzle according to claim 3 in which the one of said surfaces intermediate said zones is formed from a material different to that forming the valve member.

5. A nozzle according to claim 4 in which the different material is accommodated within a groove formed in the valve member.

6. A nozzle according to claim 5 in which said different material is copper, the valve member being formed from steel.

7. A nozzle according to claim 6 in which the groove is filled with electro deposited copper.

8. A nozzle according to claim 3 in which the one of said surfaces intermediate said zones is formed from a material structurally different to that forming the zones.

9. A nozzle according to claim 8 in which the one of said surfaces forming the sealing zones is formed from case hardened material.

10. A nozzle according to claim 9 in which said one surface is of substantially conical form.

* * * * *